United States Patent [19]

Gillespie et al.

[11] Patent Number: 4,666,045

[45] Date of Patent: May 19, 1987

[54] PIT DETECTING

[75] Inventors: Robert M. Gillespie, Grand Rapids, Mich.; John R. Ricks, Yardley, Pa.

[73] Assignee: Dunkley International Inc., Kalamazoo, Mich.

[21] Appl. No.: 637,741

[22] Filed: Aug. 6, 1984

[51] Int. Cl.[4] ..... B07C 5/342

[52] U.S. Cl. ..... 209/585; 99/490; 209/558; 209/586; 209/588; 356/239

[58] Field of Search ..... 209/555, 556, 558, 576, 209/577, 579, 585, 586, 588, 639; 99/490; 250/223 R; 356/386, 387, 239

[56] References Cited

U.S. PATENT DOCUMENTS

| | | | |
|---|---|---|---|
| 3,005,548 | 10/1961 | Flanders et al. | 209/588 X |
| 3,275,136 | 9/1966 | Allen et al. | 209/588 X |
| 3,366,236 | 1/1968 | Breazeale | 209/589 X |
| 3,545,610 | 12/1970 | Kelly et al. | 209/579 |
| 3,628,657 | 12/1971 | Billett | 209/639 X |
| 3,768,645 | 10/1973 | Conway et al. | 209/589 X |
| 3,880,289 | 4/1975 | Gray . | |
| 3,930,994 | 1/1976 | Conway et al. | 209/579 |
| 4,025,422 | 5/1977 | Malvick et al. . | |
| 4,146,135 | 3/1979 | Sarkar et al. . | |
| 4,407,415 | 10/1983 | Bohme et al. | 209/576 X |

*Primary Examiner*—Robert B. Reeves
*Assistant Examiner*—Edward M. Wacyra
*Attorney, Agent, or Firm*—Varnum, Riddering Schmidt & Howlett

[57] ABSTRACT

A pit detection apparatus (10) and method for detecting the presence of pits or pit fragments (12) in fruit (14) as the fruit (14) passes through a zone of inspection (16) includes a scanning beam generator (17) for sweeping a transmission scanning beam (28) across the inspection zone (16). The inspection zone (16) is located intermediate the beam generator (17) and an array (38) of transmission sensors (40). The sensors (40) generate transmission sensor signals indicative of received light intensity from the beam (28). A second sizing beam generator (50) and associated array (60) of sensors (62) generate sizing signals representative of te optical path length through which the transmission scanning beam (28) travels within the fruit (14). The transmission sensor and sizing signals are applied to an analysis circuit (44) wherein the signals are analyzed to determine the presence or absence of pits or pit fragments (12). The analysis of the transmission sensor signals is synchronized with the transmission scanning beam (28) so as to utilize only those portions of the signals representative of the direct light in the field of view of the transmission sensors (40). An ejector valve (76) is enabled to direct an air blast against fruit falling through the inspection zone and deflect the fruit (14) from its normal path when a pit (12) is detected.

22 Claims, 8 Drawing Figures

PIT DETECTING

DESCRIPTION

1. Technical Field

The invention relates to pit detecting and, more particularly, to apparatus and methods employing optical generation and sensing devices to determine the presence of pits in comestibles such as fruit.

2. Background Art

Many comestibles, such as cherries, peaches and other types of fruit, grow in their natural state with a stone (commonly referred to as a "pit") centrally embedded within each individual comestible. When the comestibles are commercially processed for purposes such as canning, the pits are usually removed. However, even with the use of sophisticated and automated devices to remove the pits, the typically large number of individual comestibles which must be processed at a relatively rapid rate results in a finite probability that some pits will be missed during the pitting process. In addition, although a particular comestible may be subjected to the pitting process, the process can sometimes result in a partial pitting, whereby pit fragments remain within the comestible.

To avoid the problems associated with the imperfect pitting process, the comestibles can be subjected to a subsequent inspection. Manual inspection, of course, is extremely tedious and slow. In addition, with the pit or pit fragments embedded within the comestibles, detection of the pits can require substantial physical handling of the comestibles. If the comestibles are a relatively delicate type of fruit, such as cherries, this type of physical manipulation may be damaging.

The problem of detecting pits and pit fragments is also aggravated by the nature of the comestibles. Comestibles such as cherries and other fruit typically vary in size and may have irregular shapes. Automated means to detect the presence of pits or pit fragments therefore cannot depend on the comestibles having uniform sizes and shapes.

In view of the various factors involved in detecting pits in fruit comestibles, several types of automated pit detecting devices heretofore developed employ electromagnetic signals and associated sensing devices, wherein the signals are of frequencies within the optical or radiation ranges. For example, in the U.S. Patent to Billett U.S. Pat. No. 3,628,657 issued Dec. 21, 1971, an apparatus for detecting a pit or pit fragment in peach halves includes a laser light source directed towards an oscillating mirror to produce a scanning light beam. As the peach halves are moved on a conveyor through an inspection zone, the scanning light beam is passed through the peach half and intersected by a perpendicular diffusing screen and light sensing device on the other side of the peach half. In view of the substantially opaque characteristics of pits relative to other portions of the peach half, the magnitude of light intensity passing through the peach half and impinging on the light sensing device is reduced substantially when a pit or pit fragment is present.

Other types of pit detection systems employing light transmission and sensing apparatus have also been developed. For example, in the U.S. Pat. No. to Sarkar, et al, 4,146,135 issued Mar. 27, 1979, an apparatus for detecting peach pits and pit fragments employs two rays of light sources generating light beams at differential wave lengths. One of the light source rays is energized for a portion of a detection cycle controlled by clocking apparatus. Light sensors are positioned so as to receive light reflected from the peach half. The second light source is energized for each entire clock cycle, and signals are generated representative of the difference between light sensor output signals when the first light source is energized and when de-energized. With the light sources having different wave lengths, one of the light sources is more readily reflected from the peach half when a pit fragment is detected. The differencing circuitry and employment of light sources having differential wave lengths provides a relatively high degree of resolution in detection of pit fragments in peach halves and similar fruit.

Although several types of pit detection devices utilizing light sources and light sensing circuits are well known, many are specifically adapted to relatively large fruit such as peaches and require the fruit to be halved and oriented. Detection of pits in smaller, more delicate fruit, such as cherries, can present additional difficulties. While maintaining the cost of the detection apparatus within reasonable bounds, the relatively smaller diameter of cherries precludes halving and orienting and thus makes detection of the presence of pits somewhat more difficult. If a scanning light source is used to transmit a light beam through the cherries, sensors employed to sense the light intensity may not be sufficiently accurate to appropriately detect the pits.

When a scanning light source is applied to light sensing circuits, sensors to which the light is specifically directed (by reflection, refraction, or direct transmission) at any given instant of time will readily detect light intensity. However, adjacent sensors can also detect a substantial amount of light. If a pit or pit fragment is relatively small, the indirectly sensed light can result in relatively poor resolution and difficulty in accurately determining if the sensor output signals represent the existence of a pit or pit fragment.

Additional problems can arise when the pit detection apparatus must be adapted to fruit having substantially different sizes, including relatively small fruit such as cherries and the like. If the transmitted light is passed through the fruit, the magnitude of intensity will be partially dependent on the size of the fruit. Accordingly, if circuitry is adapted to accurately detect pits or pit fragments in relatively small pieces of fruit, then relatively larger pieces of fruit without pits may cause intensity signals in a similar range. That is, a relatively long path of travel through larger fruit will result in reduction of light intensity to a range similar to that occurring when a pit exists in a much smaller piece of fruit.

SUMMARY OF THE INVENTION

In accordance with the invention, an improvement is provided in a pit detection apparatus for detecting the presence of a pit in pieces of fruit as the fruit passes through a zone of inspection. The detection apparatus includes first optical means to periodically transmit a transmission scanning beam across the inspection zone. First sensing means sense the light intensity of the transmission scanning beam after the beam has passed through the inspection zone, and generate transmission sensor signals indicative of the light intensity. The improvement includes path length means for determining the length of the optical path of the transmission scanning beam through the fruit. The path length means generates a path length signal indicative of the optical path, and a detection circuit means is responsive to the transmission sensor signals compensated by the path length signal for determining the presence of the pit.

The first sensing means includes a plurality of electro-optical sensors electrically responsive to reception of light intensity from the transmission scanning beam. The detection apparatus includes synchronization detection means to detect a position of the transmission scanning beam and generate a scan sensor signal indicative thereof. The detection circuit means determines the presence of a pit based only upon portions of the transmission sensor signals representative of light intensity detected by the sensors during time intervals when the transmission scanning beam is within a field of view of each sensor.

The detection circuit means also includes filtering means to filter from the transmission sensor signals those signal levels representative of ambient light intensity. In addition, the detection apparatus can include discrimination means to remove optical noise signals from the transmission scanning beam.

The path length means can include second optical means for transmitting a path length detection beam across the inspection zone in a direction substantially transverse to the direction of the transmission scanning beam. The second sensing means sense the light intensity of the sizing beam after the beam has passed through the inspection zone, and generate a path length signal indicative of the portion of the beam which is blocked by the fruit.

The detection circuit means includes comparison means for comparing the path length signal with the transmission sensor signals. The determination of the presence of a pit is based on the comparison. The path length signal is compared only with those portions of the transmission sensor signals representative of direct light sensed by the first sensing means from the transmission scanning beam.

Each of the transmission sensors generates a separate one of the transmission sensor signals. The detection circuit means includes amplifier means responsive to the individual transmission sensor signals for filtering the signal levels representative of light intensity resulting from ambient light detected by the first sensing means.

The amplifier means is responsive to the scan sensor signal for filtering the signal levels of the transmission sensor signals representative of ambient light. The amplifier means also includes means for adjusting the gain of the transmission sensor signals to a selectively adjustable gain level.

The detection circuit means can include multiplexer means responsive to the transmission sensor signals for generating a transmission scan signal corresponding to the portion of each transmission sensor signal representative of light intensity sensed during the time interval when the transmission sensing beam is directly within the field of view of each sensor. Driver control means are responsive to the scan sensor signal to generate multiplexer control signals. The multiplexer control signals are utilized by the multiplexer means to sequentially sample each of the transmission sensor signals only during the time intervals that the corresponding sensors are detecting direct light from the transmission scanning beam.

A method for detecting pits in fruit in accordance with the invention includes the periodic transmission of an optical transmission scanning beam across a zone of inspection through which the fruit travels. Light intensity of the transmission scanning beam is sensed after the beam passes through the inspection zone, and transmission sensor signals are generated indicative beam through the fruit is then determined, and a path length signal is generated indicative of the path length. The presence of a pit is determined based upon the amplitudes of the transmission sensor signals compensated by the amplitude of the path length signal.

The method can also include detecting a position of the transmission scanning beam during each scan thereof, and generation of a scan sensor signal indicative of the position. The presence of a pit can be determined based only upon portions of the transmission sensor signals representative of direct light detected from the transmissions scanning beam. The method can also include transmission of an optical path length detection beam across the inspection zone in a direction transverse to the direction of the transmission scanning beam. The light intensity of the path length detection beam can be sensed after the beam has passed through the inspection zone, and the path length signal generated in accordance with the portion of the beam which is blocked by the fruit.

BRIEF DESCRIPTION OF THE DRAWINGS

The invention will now be described with reference to the drawings in which.

DETAILED DESCRIPTION

Figure 1:
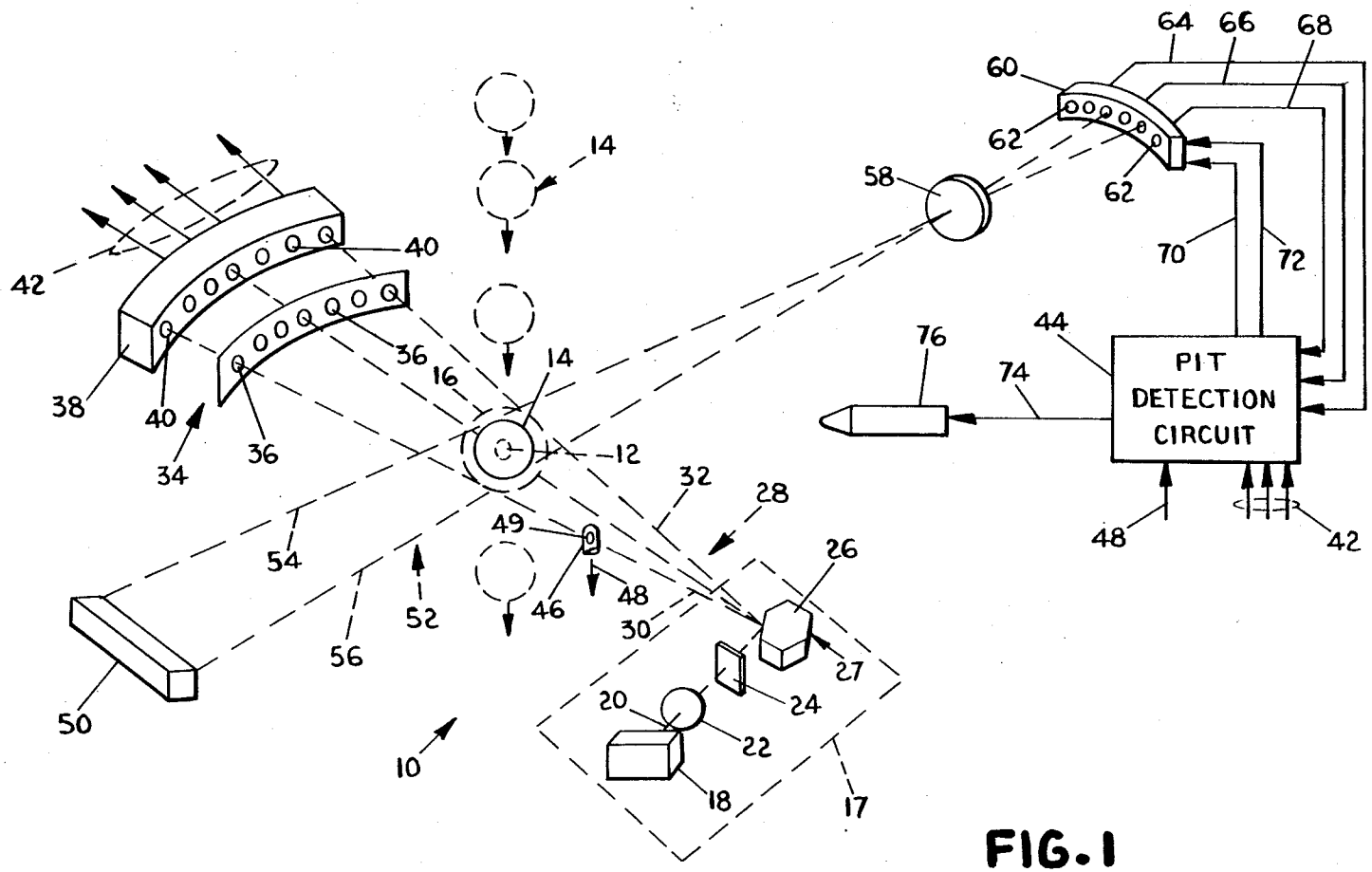
FIG. 1 is a perspective view of the principal electrical components of a pit detection apparatus in accordance with the invention.
Figure 2:
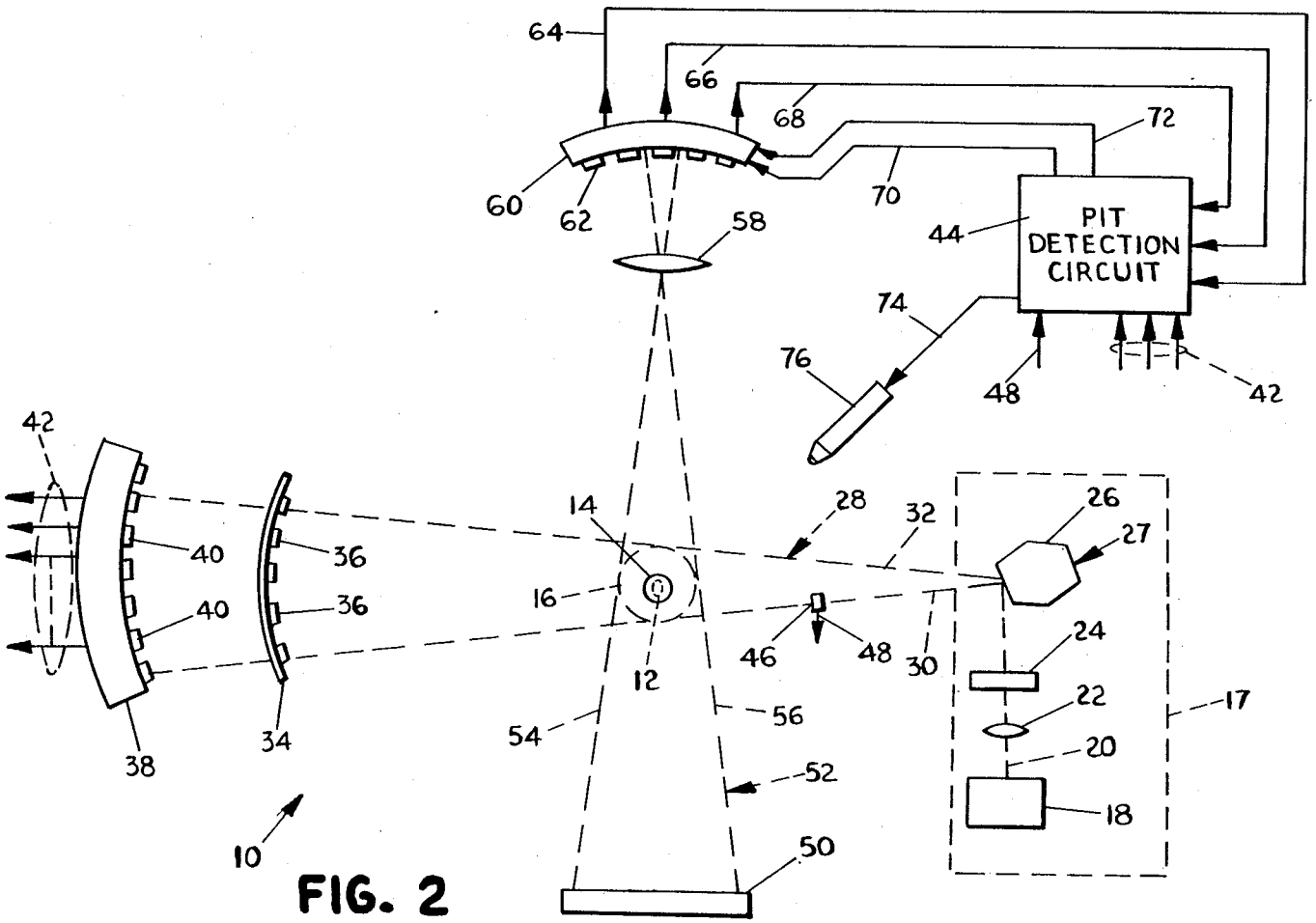
FIG. 2 is a plan view of the pit detection apparatus shown in FIG. 1.

The principles of the invention are disclosed, by way of example, in a pit detection apparatus 10 as shown in FIGS. 1 and 2. The detection apparatus 10 is adapted to detect the presence or absence of pits or pit fragments 12 within fruit 14 as the fruit 14 sequentially pass through a zone of inspection 16. The fruit 14 can comprise cherries or similar types of fruit containing pits when in their natural state. The fruit 14 will have been processed to remove the pits and the detection apparatus 10 provides a means for inspecting the fruit 14 and separating the individual pieces of fruit 14 having remaining pits or pit fragments 12 from those pieces for which the pitting process was properly performed.

To inspect the individual pieces of fruit 14, they are dropped or otherwise passed through the inspection zone 16 seriatim as shown in FIG. 1. For purposes of description, the mechanical devices and structure for dropping the fruit 14 through the inspection zone 16, and for mounting and locating the various electrical and electro-mechanical components of the detection apparatus 10, are neither shown in the drawings nor described herein. Devices for accurately passing fruit through an inspection zone at a desired rate for purposes of detecting pits or pit fragments through the use of light sources and sensing devices are well known in the art, and do not form the basis for any of the novel concepts of the invention.

Referring specifically to FIGS. 1 and 2, the pit detection apparatus 10 comprises a scanning beam generator 17 having a light source 18 for generating a narrow collimated light ray 20. The light source 18 can, for example, be a laser light generator or similar device for transmitting a directed ray of light 20. The light ray 20 is passed through a condensing lens 22 which serves to increase the intensity of the beam.

The resultant condensed ray of light emerging from the lens 22 is further passed through a beam focusing lens 24 which focuses it into a narrow, collimated beam. Both lenses 22 and 24 may be eliminated if the light source 18 is a laser. The resultant focused ray of light emerging from the focusing lens 24 is applied to a rotating mirror 26 having a prism-like configuration with vertically disposed sides 27 configured in a manner such that the rotating mirror 26 has a planar cross section in the form of a regular polygon.

The beam focusing lens 24 is adapted to direct the light ray 20 in a particular direction such that the light ray 20 impinges on different sides 27 of the mirror 26 as the mirror 26 is rotated. Rotation of the mirror 26 thereby causes reflection of the light ray 20 in a manner so as to generate a transmission scanning beam 28 sweeping across an arc having its boundaries defined by the beam paths designated as the left-most beam path 30 and the right-most beam path 32 in FIGS. 1 and 2. It will be apparent that the rate at which the scanning beam 28 sweeps across the arc defined by paths 30 and 32 is dependent on the rate of rotation and the particular configuration of the rotating mirror 26.

The fruit 14 are dropped through the inspection zone 16 in a manner such that each individual fruit 14 is substantially centrally located relative to the outer boundaries 30 and 32 of the sweep of scanning beam 28. The configuration of the rotating mirror 26 and the distance between mirror 26 and the path through which the fruit 14 are dropped essentially define the size of the inspection zone 16. Preferably, the inspection zone 16 should be of a size sufficiently large such that the largest pieces of fruit 14 remain completely within the inspection zone 16 as they pass through the horizontal plane defined by the sweep of scanning beam 28.

Located directly across from the rotating mirror 26, and positioned on substantially the same horizontal plane as the mirror 26, is an imaging lens array 34 comprising a series of individual imaging lenses 36. The lenses 36 serve to focus the light rays from the scanning beam 28 as the beam is swept across the inspection zone 16. Positioned directly behind the imaging lens array 34 relative to the inspection zone 16 is a transmission sensor array 38 comprising a series of individual transmission sensors 40. The transmission sensors 40 are adapted to detect light rays from the scanning beam 28 and generate electrical output signals on lines 42, wherein the magnitudes of the output signals are proportional to the intensity of light sensed by each of the corresponding transmission sensors 40. The signals on lines 42 are applied as input signals to pit detection analysis circuit 44 and utilized as described in detail subsequently herein. Sensors capable of generating electrical signals representative of the intensity of light impinging on the sensors are well known in the art. For example, the sensors 40 can comprise conventional photovoltaic detectors capable of generating a signal having a magnitude dependent on the light intensity.

The pit detection apparatus 10 also includes a synchronization scan circuit 46 located in the the leftmost beam path 30 as depicted in FIGS. 1 and 2. The synchronization circuit 46 comprises a conventional photoelectric sensing device 49 such as a photodiode which detects the scanning beam 28 when it is aligned with the leftmost path 30. When the beam 28 is located at the leftmost path 30, the sensor 49 is excited and an output signal is generated on line 48 indicative of the initialization of a scan. The output signal on line 48 is applied as an input to pit detection analysis circuit 44 as described in detail subsequently herein.

Positioned at approximately a 90° angle from scanning beam generator 17 relative to the inspection zone 16 is a second light generating system 50. Light generating system 50 generates a uniform background illumination over the entire field of view of the imaging lens 58. Boundaries 54 and 56 show the field of view for the imaging lens 58. The imaging lens 58 directs its view through the inspection zone 16 on a horizontal plane substantially equivalent to the plane of the scanning beam 28 and at substantially a right angle to the path of beam 28. The light generating system 50 can comprise any one of a number of conventional and well-known light source devices adapted to generate a uniform background illumination.

Located on an opposite side of inspection zone 16 across from the sizing beam generator 50 is an imaging lens 58. The imaging lens 58 is located at a position so that it will focus an image of the fruit 14 in the inspection zone 16 on the sizing sensor array 60.

Positioned spaced apart from the imaging lens 58 across from the inspection zone 16 is a sizing sensor array 60 as shown in FIGS. 1 and 2. Sizing sensor array 60 comprises a set of photoelectric sensors 62 located in a horizontal plane and adapted to generate output signals in response to excitation from sizing beam 52. Sensor array 60 is positioned an appropriate distance from imaging lens 58 so that each of the sensors 62 is illuminated by rays of sizing beam 52 in the absence of any blockage resulting from the presence of a fruit 14 within the inspection zone 16.

The relative locations of sizing beam generator 50, inspection zone 16, imaging lens 58 and sensor array 60, and the sensitivity of sizing array sensors 62 can be appropriately determined so as to measure the maximum diameter of the fruit 14 within the plane of sizing beam 52 and at substantially right angles to the direction of beam 52. Accordingly, a measurement is obtained of the length of the optical path of scanning beam 28 through the fruit 14. To achieve this measurement, the existence of a fruit 14 within inspection zone 16 should effectively block any response by a particular sensor 62 to optical rays of beam 52 that would directly impinge on the sensor 62, except for the presence of fruit 14.

Excitation of the sizing sensors 62 generates an output signal on line 64 in the form of a serial data signal having one bit of information for each sensor 62, the data signal indicative of each sensor 62 being in an "illuminated" or "nonilluminated" state. The sizing data signal on line 64, along with output signals on lines 66 and 68 indicative of sizing scan initialization and termination, respectively, are applied as input signals to the pit detection analysis circuit 44.

Control of the size sensor array 60 is achieved through scan initialization and clocking control signals generated by analysis circuit 44 and applied as input signals to sensor array 60 on lines 70 and 72, respectively. Each of the aforementioned signals will be described in greater detail herein with respect to the functional description of analysis circuit 44.

The input signals applied to analysis circuit 44 from transmission sensor array 38, sizing sensor array 60 and synchronization circuit 46 are utilized to determine the presence or absence of pit or pit fragments 12 within fruit 14. If a pit or pit fragment 12 is existent, the analysis circuit 44 generates an "eject" output signal on line 74. The eject signal is applied as an input to a means for removing the fruit 14 from its normal path of travel, such as the pneumatic ejector valve 76. Ejector valve 76 is a well-known and commercially available electro-pneumatic device responsive to a signal on line 74 to emit a relatively powerful blast of air for a short duration of time. With the ejector valve 76 located below inspection zone 16 and directed at right angles to the path of the fruit 14, any fruit 14 determined to have a pit or pit fragment 12 can be blown off of its normal vertical path into a bin or other means (not shown) for receiving defectively pitted fruit.

The operation of the pit detection apparatus 10 will now be described with respect to the drawings, particularly FIGS. 5*a* and 5*b* which depict a schematic block diagram of the sensor arrays 38 and 60, synchronization circuit 46, ejector valve 76 and one embodiment of the pit detection analysis circuit 44.

Referring again to FIGS. 1 and 2, as a fruit 14 passes through the inspection zone 16, the impingement of light ray 20 on mirror 26 as the mirror 26 is rotated results in a scan across the fruit 14 by transmission scanning beam 28. With the rotating mirror 26 having vertically disposed sides 27 as depicted in FIGS. 1 and 2, the scanning beam 28 initiates at the leftmost beam path 30 and sweeps across inspection zone 16 to the boundary designated as rightmost beam path 32.

The frequencies and intensity of light generated by light source 20 are chosen so that the transparent and translucent properties of the fruit 14 allows substantial transmission of beam 28 through the fruit 14 sufficient to be detected by the particular transmission sensor 40 to which the beam 28 is directed at any given instant of time. Correspondingly, an object having opaque properties, such as the pit or pit fragment 12, will effectively block the beam 28 from being received by the sensor 40 to which it is directed. Light sources and photoelectric sensors having the requisite properties to achieve the appropriate transmission and sensing of scanning beam 28 are commercially available and well-known in the field of electro-optical design.

As previously described, the synchronization sensing circuit 46 includes a photoelectric sensor 49 positioned in the leftmost scanning path 30 of scanning beam 28. The sensor 49 thereby detects initiation of the scan across inspection zone 16. Referring to FIG. 5*a*, the synchronization circuit 46 generates a voltage pulse output signal indicative of the initiation of a scan and sufficient in duration and magnitude to control timing circuitry as subsequently described herein. Although depicted only in block diagram form in FIG. 5*a*, the synchronization circuit 46 can comprise any of several known circuit designs to obtain the requisite output signal. For example, the sensor 49 can be a conventional photovoltaic detection sensor having a current output signal generated in response to optical excitation. This current output signal can be applied to an operational amplifier connected as a current to voltage converter. The resultant voltage output signal from the operational amplifier can then be applied as one input to a comparator circuit. The comparator circuit compares the amplifier output voltage to a reference voltage having a magnitude sufficient to indicate that the amplifier output voltage results from the scanning beam 28 being directed toward synchronization sensor 49. In a response to the comparison, the requisite voltage pulse output signal is generated as an output from the comparator on line 48 shown in FIGS. 1 and 5*a*.

The output signal from synchronization circuit 46 on line 48 is utilized to control various timing circuitry adapted to synchronize sequential enablement of signal detection from the transmission sensor array 40 with the scanning beam 28. One problem associated with detection of light passing through objects such as fruit 14 is the diffusion of the light by the fruit 14. Although the fruit 14 does not present opaque properties (except where a pit is present), the fruit 14 is not completely transparent. To the extent that fruit 14 presents translucent properties, some diffusion of the scanning beam 28 will occur. In addition, notwithstanding the narrow width of scanning beam 28, sensors 40 near the particular sensor to which the beam 28 is directed at any given instant of time will detect some light diffused from beam 28. The foregoing can result in difficulties in properly detecting the presence of a pit or pit fragment 12.

To overcome this problem, and as described in more detail in subsequent paragraphs, the detection of signals from the sensors 40 is synchronized with scanning beam 28 so that each individual sensor 40 is effectively "sampled" only when the scanning beam 28 is directed at the specific individual sensor 40. In addition to control of synchronization of the transmission sensor signal detection with the scanning beam 28, the output signal from synchronization circuit 46 on line 48 is also utilized to control the timing of the size measuring function and comparison of signals representative of the transmission scan and sizing scan. Each of these functions will be described in greater detail herein with respect to FIGS. 5*a* and 5*b*.

Figure 5A:
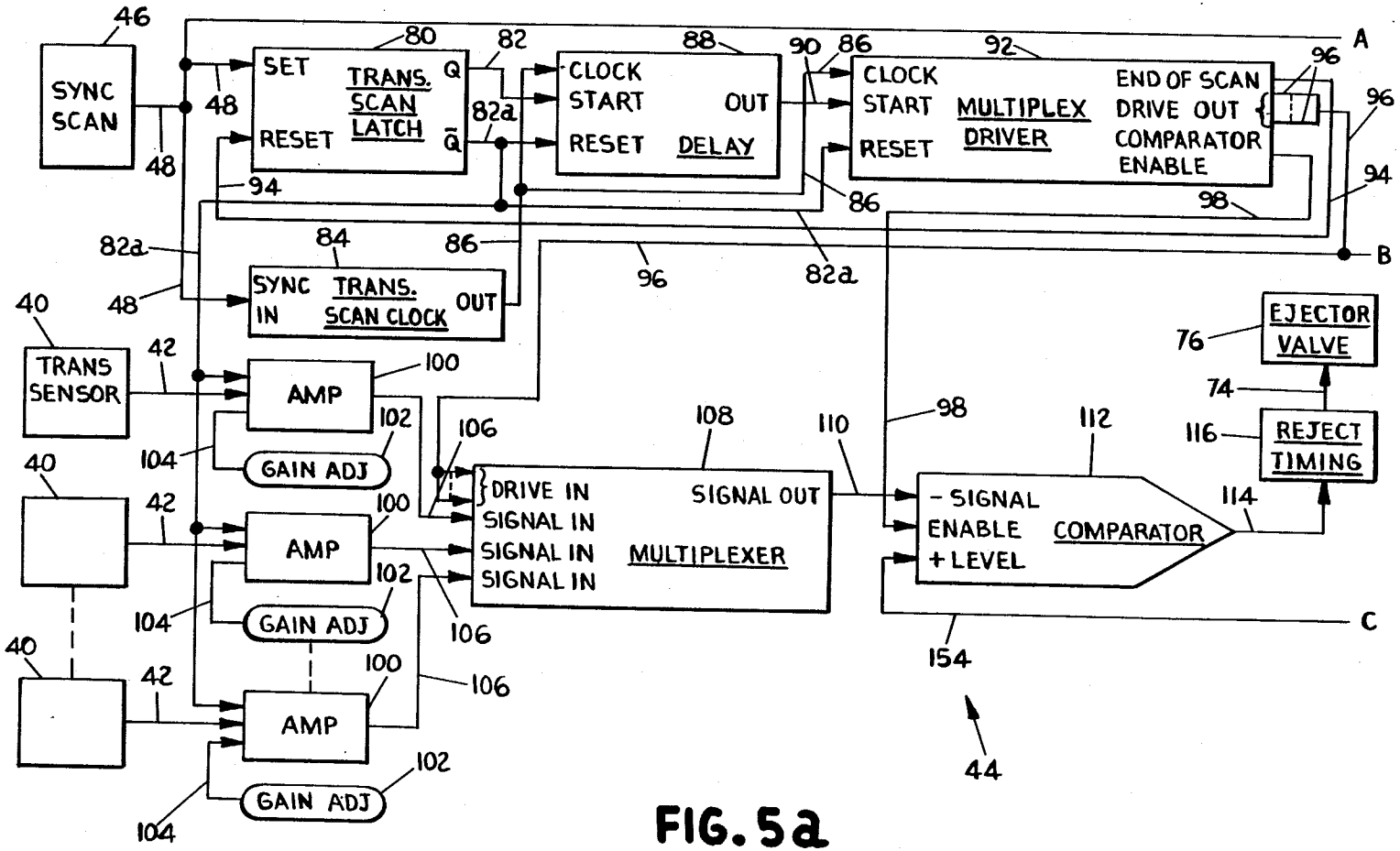
FIG. 5*a* is a block diagram of one embodiment of the pit detection circuitry employed in the pit detection apparatus shown in FIG. 1.

As depicted in FIG. 5*a*, the voltage pulse output signal on line 48 from synchronization circuit 46 is applied as an input signal to a transmission scan latching circuit 80. Scan latching circuit 80 is utilized to control clock timing associated with the scan or sampling of the transmission sensors 40, and is further utilized to disable (commonly referred to as a "clamp enable" or a "clamp" function) output from amplifiers subsequently described herein during time intervals between successive scans. The "clamp" function eliminates the effect of any changes in ambient light level. The scan latching circuit 80 can be any one of several circuit component designs, including a conventional and commercially available SR flip-flop with an output terminal Q and inverse signal output terminal $\overline{Q}$ as depicted in FIG. 5*a*.

In the circuit configurations shown in FIG. 5*a*, the output signal from synchronization sensor circuit 46 on line 48 is applied as an input to the S ("set") terminal of scan latching circuit 80. Correspondingly, output lines 82 and 82*a* are connected to the Q and $\overline{Q}$ output terminals, respectively. In accordance with conventional flip-flop design, a pulse signal applied to the S input terminal on line 48 will result in the generation of a binary signal on line 82 having a first state level. Correspondingly, the other state level of the binary signal will appear on line 82*a* connected to terminal $\overline{Q}$. To reset latching circuit 80, a pulse signal can be applied to the R ("reset") input terminal to which line 94 is connected.

The output signal on line 48 from synchronization sensor circuit 46 is also applied as an input signal to the transmission scan clock 84. Scan clock 84 is utilized to determine the actual clocking rate at which the previously mentioned amplifiers are enabled and the output signals from the transmission sensors 40 are sampled. The scan clock 84 can comprise a conventional phase-locked loop with associated well-known circuitry to synchronize the frequency of a clock output signal on line 86 with the scan rate of the transmission scanning beam 28 as represented by the frequency of the voltage pulse signals from synchronization sensor circuit 46 applied as an input to scan clock 84 on line 48. The phase-locked loop effectively provides automatic frequency control. Principles associated with phase-lock control and exemplary phase-locked loop circuits are described in *Phase-Lock Techniques* by Gardner (Wiley 1966).

The clock pulse output signal on line 86 from transmission scanning clock 84, along with the latching output signals on lines 82 and 82*a* from transmission scan latching circuit 80, are each applied as input signals to delay circuit 88 as depicted in FIG. 5*a*. For purposes of accuracy and to allow for signal time delays through various circuit components, the synchronization sensor 49 is aligned with other physical elements of detection apparatus 10 in a manner such that sensor 49 detects initiation of a scan of scanning beam 28 prior to alignment of scanning beam 28 with the first of the transmission sensors 40 in array 38. The purpose of delay circuit 88 is to delay control signals enabling initiation of a scan or sampling of the transmission sensors 40 until the scanning beam 28 is aligned with and directed toward the first transmission sensor 40.

To allow for a desired setting and modification of the actual delay interval (measured in terms of clock pulses applied as an input signal on line 86), the delay circuit 88 can be a programmable counter or similar circuit allowing for actual setting of the delay interval. Changes in the delay interval may be desired if changes are made in the physical alignment of the various components of detection apparatus 10, or in the rotation rate of rotating mirror 26, etc. Initiation of the delay interval is made in response to a "start" signal. This start signal is provided by the output signal of scan latching circuit 80 at the Q output terminal applied to line 82. Correspondingly, the delay circuit 88 is reset by means of an input signal on line 82*a* corresponding to the output signal at the Q terminal of scan latching circuit 80. Delay circuit 88 can comprise any one of several well-known and commercially available circuit designs, including various types of programmable counters which preferably allow on-site modification of the actual delay interval.

The output signal generated from delay circuit 88 is applied to line 90 and comprises a binary signal delayed a predetermined interval of time after application of the start signal on line 82 to the circuit 88. The signal on line 90 is applied as an input "start" signal to the multiplex driver 92 as depicted in FIG. 5*a*. Also applied as input signals to multiplex driver 92 are the clocking output signal on line 86 from transmission scan clock 84, along with a "reset" signal corresponding to the output signal at the $\overline{Q}$ terminal of scan latching circuit 80 on line 82*a*. Driver circuit 92 is responsive to the input signals to generate a driver output signal on line 96 utilized to control the operational sequence of multiplexer circuit 108 subsequently described herein. Line 96 can actually comprise a set of parallel lines, and the driver output signal can comprise binary pulses generated in parallel so as to form a pulse control signal consisting of a number of states. For example, if line 96 comprises five parallel signal lines, a pulse driver control signal can be generated thereon having up to 32 states.

In addition to generation of the driver output signal on line 96, the multiplex driver circuit 92 is also utilized to generate an "end of scan" pulse control signal on line 94. The "end of scan" control signal is applied as an input to the reset terminal of transmission scan latching circuit 80 to reset latching circuit 80 at the end of the control sequence provided by the multiplex driver output signal on line 96. In response to the reset signal on line 94, the scan latching circuit 80 will cause the output signal on line 82*a* at the $\overline{Q}$ output terminal to change states so as to reset delay circuit 88 and to further reset multiplex driver circuit 92. In addition, the multiplex driver circuit 92 also generates a "comparator enable" output signal on line 98. The comparator enable signal on line 98 is applied as an input signal to comparator 112 to enable the same as subsequently described herein.

Multiplex driver circuits capable of being utilized as driver circuit 92 are commercially available and well-known in the art of electronic design. Driver circuits corresponding to multiplex driver 92 typically comprise various counters and divider circuitry utilized to generate the previously described output signals on lines 94, 96 and 98. The sequence of generation of the driver output signals on line 96 is initiated by reception of the start signal on line 90 applied as an output signal from the delay circuit 88. Correspondingly, reset of the control sequence of multiplex driver circuit 92 is provided by application of a reset signal on line 82*a* from the scan latching circuit 80. The rate at which the driver output signal control sequence is generated is determined by the clock pulses applied as input signals on line 86 from the transmission scan clock 84.

The synchronization sensor circuit 46 can be characterized as a means for detecting the scanning rate and initiation of each scan of the scanning beam 28. Correspondingly, the transmission scan clock 84, scan latching circuit 80, delay circuit 88 and multiplex driver circuit 92 can be characterized as a means responsive to signals received from the synchronization sensor circuit 46 to control transmission sensor signal detection and to synchronize the signal detection with the scanning beam 28 as subsequently described herein.

Turning to the specific transmission scanning components, the transmission sensor array 38 comprises a series of sensors 40 aligned in a horizontal plane as shown in FIGS. 1 and 2, and as previously described herein. Referring to FIG. 5*a*, each of the sensors 40 is responsive to optical detection of light from scanning beam 28 to generate an analog voltage signal on its associated one of the signal lines 42. The output signal on line 42 from the associated sensor 40 is proportional to the magnitude of light intensity striking the particular sensor 40. When a fruit 14 is in the inspection zone 16 as depicted in FIG. 1, the output signal from a sensor 40 when the scanning beam 28 is directed towards the particular sensor 40 will be proportional to the magnitude of light intensity transmitted through the fruit 14.

Each of the transmission sensors 40 of array 38 can comprise well-known and commercially available circuit components configured so as to provide the requisite voltage signal on line 42 in response to detection of light from scanning beam 28. For example, each individual sensor 40 can comprise a conventional photovoltaic detector responsive to excitation by optical signals to generate a current signal proportional to the intensity of optical excitation. To convert the current signal to an appropriate voltage signal for transmission on line 42, the current signal can be applied to an operational amplifier arrangement configured in a conventional manner as a current to voltage converter circuit.

Figure 3:
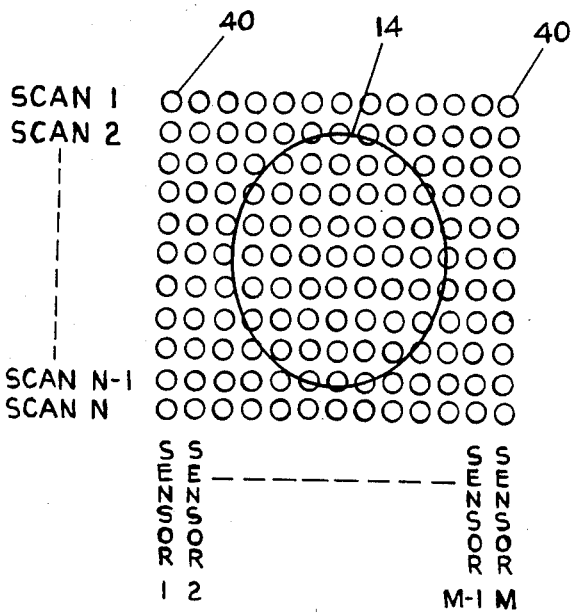
FIG. 3 is a diagram of the areas seen by the light transmission sensors of the pit detection apparatus shown in FIG. 1 during successive scans when a piece of fruit is passing through the inspection zone.

To achieve substantial accuracy and detection, each of the sensors 40 can have an optical configuration effectively restricting the spatial field of view of each photovoltaic detector to a relatively small portion of the inspection zone 16. For example, if the inspection zone 16 has a nominal width of approximately three inches, the sensor array 38 can be designed so as to comprise twenty-two sensors 40, each having a photovoltaic detector with a spatial field of view restricted to a square area having sides of approximately 0.125 inches at the inspection zone 16. FIG. 3 depicts the effective field of view of the sensors 40 in successive scans as a fruit 14 passes through inspection zone 16.

Each of the transmission sensor output signals on its associated line 42 is applied as an input signal to an amplifier circuit 100. In accordance with the invention, the amplifier circuits 100 each generate an amplifier output signal on an associated output line 106, wherein each output signal represents the light intensity level detected by the corresponding sensor 40 relative to ambient light detected by the sensor 40 during intervals between scans of the scanning beam 28. In addition to the input signal from the corresponding sensor 40, a "clamp enable" signal is also applied as an input to each amplifier 100 from line 82*a* as shown in FIG. 5*a*. The clamp enable signal on line 82*a* corresponds to the output signal at the $\overline{Q}$ output terminal from scan latching circuit 80. Still further, a "gain adjust" signal is applied as an input to each amplifier 100 on individual lines 104. Each gain adjustment signal on line 104 comprises an output signal generated from an associated gain adjustment circuit 102. Each of the gain adjustment circuits 102 can be functional in nature and, in fact, comprise an inherent portion of an associated amplifier 100 in a physically realized design. The gain level can be selectively modified by the user to provide an appropriate gain to the amplifier output signals as generated on lines 106.

The number of amplifiers 100 corresponds to the particular number of sensors 40 utilized in the detection apparatus 10. For example, if 22 sensors 40 are utilized, there will be 22 individual amplifier circuits 100, one corresponding to each of the sensors 40. Each of the amplifier circuits 100 comprises relatively well-known and conventional circuitry to generate appropriate signals 106 in response to the input signals on lines 42, 82*a* and 104. For example, each amplifier circuit 100 can comprise a three-stage series configuration. The first stage directly employs the transmission sensor signal on line 42 and provides a fixed gain to amplify the signal. The second stage can be characterized as a "clamping" stage connected in series to the fixed gain stage, and responsive not only to the output of the fixed gain stage, but also to the clamp enable signal received on line 82*a* to clamp its output signal to ground between sweeps of the scanning beam 28. That is, when the scan latching circuit 80 receives a signal at its reset input terminal on line 94 indicative of the end of a scan, the signal on line 82*a* at the $\overline{Q}$ output terminal of latching circuit 80 will change states to an appropriate level so as to enable the clamping stages of each of the amplifier circuits 100. When a sweep of the scanning beam 28 is initiated, an appropriate signal will be received at the set terminal of latching circuit 80, thereby changing the state of the output signal on line 82*a* so as to disable clamping of each of the amplifier circuits 100.

The output signal from the clamping stage of each amplifier circuit 100 can be applied as an input to a third adjustable gain stage. The adjustable gain stage is responsive to the gain adjustment signal on line 104 to appropriately adjust the output of the adjustable gain stage on line 106 to achieve requisite signal levels for input to the multiplexer circuit 108 subsequently described herein. With the clamping stage being responsive to clamp enable signals on line 82*a*, the output signals on lines 106 will effectively be clamped to ground during intervals between scans. Correspondingly, during a sweep of the scanning beam 28, each of the amplifier circuits 100 will be enabled so as to appropriately amplify the input signals on lines 42 and generate the resultant signals adjusted by gain adjustment signals on lines 106. In accordance with the foregoing, the output signals on lines 106 will represent the difference between light intensity levels detected by sensors 40 during a sweep of the scanning beam 28 and the light intensity levels detected between intervals of the scanning beam sweeps. The portion of the levels of output signals on lines 106 which would result solely from ambient light are thus effectively filtered and removed from the amplifier output signals on lines 106. Signal levels on lines 106 therefore represent light intensity levels resulting solely from the scanning beam 28.

The amplifier output signals on lines 106 are applied as inputs to the multiplexer circuit 108 as depicted in FIG. 5*a*. Also applied as an input signal to multiplexer 108 is a drive control signal on line 96. As previously described, the drive control signal on line 96 comprises a binary coded control signal generated by the multiplex driver circuit 92. In accordance with the invention, the multiplexer circuit 108 is responsive to the drive control signal on line 96 and the amplifier output signals applied as inputs on lines 106 to generate a transmission scan signal on line 110. The transmission scan signal on line 110 is an analog signal comprising signal levels representative of the light intensity detected by each of the sensors 40 only during the time interval that the transmission scanning beam 28 is directed at the field of view of each particular sensor 40. Accordingly, when the scanning beam 28 is directed at a particular sensor 40, indirect light from scanning beam 28 detected by others of the sensors 40 is not represented within the signal levels of the transmission scan signal generated on line 110.

To achieve the foregoing, the multiplexer circuit 108 can comprise a series of conventional analog switches, with each of the amplifier output signals on lines 106 applied as an input signal to different ones of the analog switches. Also applied in a suitable manner as an input to each of the analog switches is the drive control signal on line 96. Accordingly, the particular number of analog switches will correspond to the selected number of amplifier circuits 100 and transmission sensors 40. With each of the amplifier output signals applied as an input to different ones of the analog switches, and the switches enabled sequentially, the outputs of the analog switches can be connected together in any suitable manner.

The analog switches are configured so that each is enabled in response to different ones of binary codes represented by the drive control signal on line 96. The drive control signal generated by multiplex driver circuit 92 will thereby enable the analog switches so that an amplifier output signal on a particular line 106 will be "passed through" its corresponding switch only when the scanning beam 28 is directed at the field of view of the particular sensor 40 having a detected light intensity represented by the amplifier output signal. It will be apparent from the foregoing that the analog switches are thus enabled in a sequence corresponding to the spatial sequence of the sensors 40. In this manner, detection of light intensity by sensors 40 is synchronized with the sweep of scanning beam 28.

Figure 7:
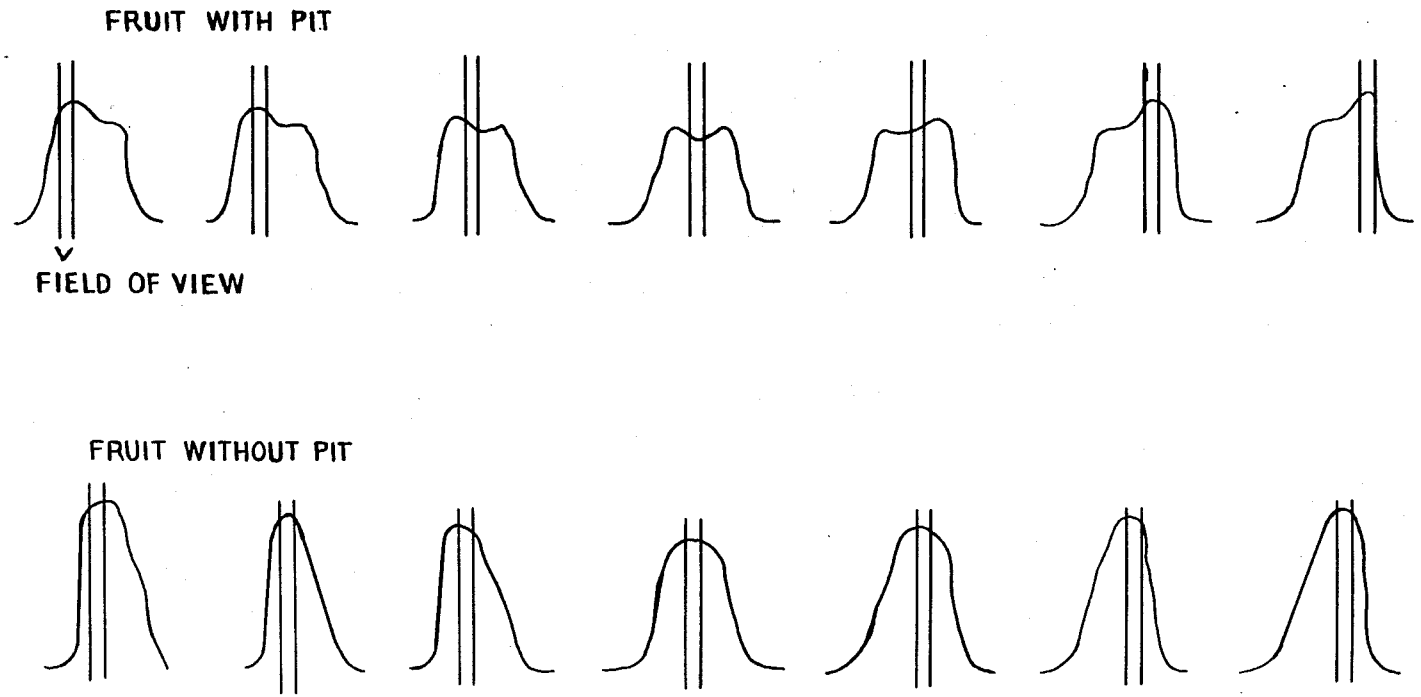
FIG. 7 is a series of diagrams showing the relative light intensities received during scans of particular pieces of fruit, one having a pit and one without a pit.

The resultant transmission scan signal on line 110 can be characterized as a composite transmission "video" signal consisting of signals representative of each transmission sensor 40 as the scanning beam 28 is sequentially directed at the field of view of successive sensors 40. FIG. 7 represents diagrams of the transmission scan signal with the areas bounded by the vertical lines corresponding to the sensor signal "windows" sensed by multiplexer 92. This circuitry can be characterized as a means responsive to the scanning beam 28 for detecting the intensity of light passing through the fruit 14 and for generating a transmission scan signal on line 110 representative only of light intensity resulting from the scanning beam 28 and further representative only of light intensity resulting from direct transmission of light from scanning beam 28.

The transmission scan signal generated from multiplexer circuit 108 on line 110 is applied to one input terminal of a comparator circuit 112 as further depicted in FIG. 5*a*. The comparator circuit 112 is adapted to compare the transmission scan signal representative of the intensity of light transmitted through the fruit 14 with a signal also applied as an input to comparator 112 on line 154 representative of the size of the particular fruit 14 being scanned. Before describing the operation of comparator 112 and circuitry controlled by output signals therefrom, the circuit components of detection circuitry 44 associated with sizing of the fruit 14 will be described with respect to FIGS. 1, 5*a* and particularly 5*b*.

Figure 5B:
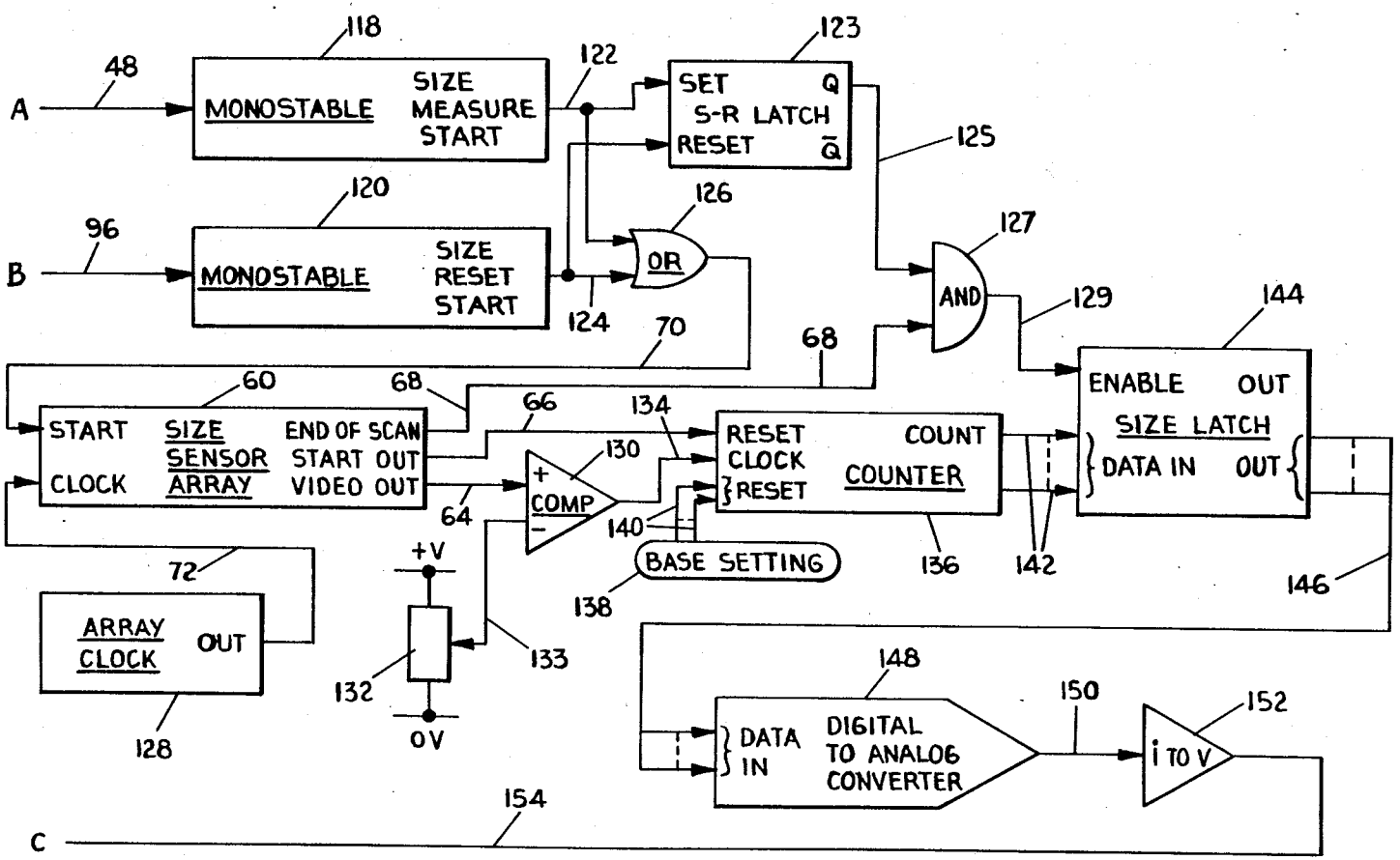
FIG. 5*b* is a continuation of the block diagram depicted in FIG. 5*a;*

Referring specifically to FIG. 5*b*, the size sensor array 60 previously described in general terms with respect to FIG. 1 can comprise a self-scanned linear array of sensors 62, each positioned on a single horizontal plane as depicted in FIG. 1. The sensors 62 within array 60 can comprise electro-optical devices such as photodiodes responsive to excitation by the sizing beam 52 to generate electrical current signals. The particular number of sensors 62 utilized should be sufficient to provide a relatively accurate size determination. For example, with the inspection zone 16 having a scanned width of approximately three inches, the linear array of sensors 62 can comprise 128 photodiodes.

As previously described with respect to FIG. 1, the sizing beam 52 and size senor array 60 are utilized to scan the fruit 14 at substantially right angles to the directional path of transmission scanning beam 28, and in the same plane as the scanning beam 28. By sizing the width of the fruit 14 within inspection zone 16 in the direction shown in FIG. 1, the size determination will correspond to the maximum length of the optical path of transmission scanning beam 28 passing through the fruit 14 during a scan.

The light generation source 50 for generating the sizing beam 52 is arranged across the inspection zone 16 from the sizing sensor array 60 so that all of the sensors 62 are normally illuminated in the absence of the fruit 14. When fruit 14 passes between the light generator source 50 and the size sensor array 60, light normally directed to a number of the senors 62 is momentarily blocked. Accordingly, amplitudes of electrical signals generated by the electro-optical sensors 62 are substantially reduced.

The electrical signal generated by each of the electro-optical sensors 62 is effectively digitized by conventional circuitry in a manner such that a signal amplitude above a predetermined amplitude corresponds to the sensor 62 being in an "illuminated" state, while signal levels below the predetermined level are characterized as representative of the sensor 62 being in a "nonilluminated" state. The electrical output signal from each of the electro-optical sensors 62 are applied in serial format to an output terminal and generated as a serial output signal on line 64 representative of the light intensity detected by each of the electro-optical sensors 62.

Referring specifically to FIG. 5*b*, to control the timing operations of sizing sensor array 60, the previously described synchronization signal generated by synchronization circuit 46 on line 48 is applied as an input to a conventional monostable circuit 118. Monostable circuit 118 is responsive to the synchronization signal on line 48 to generate a size measurement initiation signal on line 122. Correspondingly, the driver control signal generated by multiplex driver circuit 92 on line 96 as previously described is applied as an input signal to monostable circuit 120. Monostable circuit 120 is responsive to the drive control signal to generate a "reset start" signal on line 124.

The output signals from monostables 118 and 120 on lines 122 and 124, respectively, are applied as inputs to a simple "OR" gate 126 having an output on line 70 which is applied as a start signal input to the size senor array 60. When a pulse on line 70 from OR gate 126 is applied to the start terminal of sensor array 60, the sensor array 60 initiates generation of the sensor output signals on line 64. The purpose of the monostables 118 and 120 is to condition the relatively slow timing signals from the previously described transmission scanning circuitry to the relatively "fast" signals which are required to trigger initiation of functions associated with the size sensor array 60. The size measurement start signal generated by monostable 118 on line 122 results in initiation of the generation of sensor array output signals on line 64 in a manner such that the scan of size sensor array 60 is completed immediately before the scanning beam 28 begins its sweep across the transmission sensor array 38. That is, the output signal from transmission synchronization circuit 46 on line 48 causes a pulse signal to be generated on line 122, thereby correspondingly resulting in application of a pulse signal to the sensor array start terminal on line 70.

To reset the size sensor array 60, a second scan of the sensors 62, with corresponding generation of output signals on line 64, is performed to essentially "clear" the sensors 62 prior to the next sizing scan of sensors 62. To achieve the reset scan, the monostable 120 is responsive to a particular binary signal on line 96 generated by multiplex driver circuit 92. In response to this particular signal code, a size reset start pulse is applied on line 124, thereby resulting in a start pulse generated on line 70 and applied to the start input terminal of sensor array 60.

To extract the sensor array signals from sensor array 60, a size sensor array clock 128 generates appropriately timed clock pulses on line 72 which are applied as a clock input signal to the sensor array 60. The size sensor array clock 128 can be any appropriate clocking device, such as a conventional free running oscillator.

The size sensor array 60 not only generates the sensor array output signals on line 64, but also generates a signal on line 66 indicating initiation of transmission of the sequence of sensor array signals on line 64. Correspondingly, sensor array 60 also generates a signal on line 68 indicating completion of the scan of the size sensors 60 and transmittal on line 64 of the sensor output signals. The signals on lines 66 and 68 are applied to additional circuit components as subsequently described herein.

As previously described, the size sensor output signal on line 64 comprises a serial transmission of signals representative of the intensity of light from sizing beam 52 detected by each of the individual sensors 62. The sizing sensor array signal on line 64 is applied as an input to one terminal of a comparator circuit 130 as depicted in FIG. 5*b*. Also applied as an input to another terminal of comparator 130 is a fixed level voltage signal on line 133 generated by voltage generator circuit 132. Voltage generator circuit 132 can comprise any one of several adjustable voltage generators capable of manual adjustment to generate a desired fixed voltage signal on line 133.

The comparator circuit 130 is adapted to compare the size sensor array signal on line 64 with the fixed voltage level on line 133. The fixed voltage level on line 133 will correspond to that level which is characterized as distinguishing between sensors 62 which were in an "illuminated" state and those sensors 62 which were in a "nonilluminated" state. The output signal generated by comparator 130 on line 134 comprises a digital signal in serial format having binary information with a pulse or "bit" in a particular binary state representing its corresponding sensor 62 being in an illuminated state. Corresponding, the absence of a pulse, or the bit being in the other of its two binary states is representative of the associated sensor 62 being in a nonilluminated state. In this manner, the number of pulses within the serial data stream is substantially representative of the size of the fruit 14 passing through the inspection zone. That is, the fewer number of pulses within the data stream on line 134, the greater number of sensors 62 being in a nonilluminated state and, accordingly, the larger the size of fruit 14.

The serial data stream generated by comparator circuit 130 on line 134 is applied as an input signal to the clock terminal of a binary counter circuit 136. The counter circuit 136 is a conventional binary counter having the capability to be preset to a desired number. With the serial data stream on line 134 applied to the clock input of counter 136, each pulse of the data stream increments the counter 136 by one count. The counter 136 is adapted to generate output signals on lines 142 in the form of a binary coded signal representing a number corresponding to the count of counter 136. Accordingly, counter 136 effectively converts the pulses of the serial data stream on line 134 to a parallel line count information signal on lines 142 corresponding to the binary count of the number of sensors 62 being in an illuminated state.

To enable resetting of the counter 136 at the beginning of a sizing sensor scan, the previously described output signal on line 66 from size sensor array 60 is applied as a reset signal to the counter 136. In addition, because of the difference in sizes and light transmission characteristics of various types of fruit 14 which may be utilized with the detection apparatus 10, the counter 136 is adapted to receive a "preset" number of counts so as to appropriately bias the resultant binary coded count on lines 142. Presetting is achieved in a conventional manner by manually presetting the counter 136 to a desired count bias as functionally shown in FIG. 5*b* with the base setting circuit 138 and the preset base number being applied to counter 136 on lines 140.

The binary coded count signal on lines 142 representative of the number of illuminated sizing sensors 62 is applied as an input signal to a size latching circuit 144 as depicted in FIG. 5*b*. The latching circuit 144 is adapted to store and hold the binary coded count signal when the latching circuit 144 is enabled at the end of each size measuring scan. To enable the size latching circuit 144 at the end of a size measuring scan, the output signal of size measuring monostable 118 on line 122 is applied as an input signal to the S ("set") terminal of an S-R latch circuit 123. Correspondingly, the output signal of size reset monostable 120 on line 124 is applied as an input signal to the R ("reset") terminal of S-R latch circuit 123. Latch circuit 123 can be a conventional SR flip-flop functionally comparable to the previously described transmission scan latching circuit 80.

The output signal at terminal Q of latch circuit 123 is applied on line 125 as an input to a conventional "AND" gate 127. Also applied as an input to AND gate 127 is the end of scan signal generated by the size sensor array 60 on line 68. The output of AND gate 127 is applied as an input enabling signal on line 129 to enable latching circuit 144 at the end of each size measuring scan. The purpose for employing the latch circuit 123 and AND gate 127 is to enable the size latching circuit 144 at the end of each size measuring scan, while also preventing the latching circuit 144 from loading and holding the count on lines 142 from the reset scan. At the end of the size measuring scan, the latching circuit 144 will effectively "pass through" the binary coded count signal on lines 142 to the output signal lines 146. The latching circuit 144 is used to hold the count on lines 146 constant from the end of one size measuring scan until the end of the next size measuring scan.

The binary coded count signal on lines 146 is applied as an input signal to the digital to analog (D/A) converter 148. D/A converter 148 is a conventional circuit which generates an analog current signal on line 150 having a magnitude directly proportional to the binary count signal on lines 146. This count corresponds to the number of sensors 62 illuminated during the sizing scan as adjusted by the base setting from circuit 138.

The analog current signal on line 150 is applied as an input signal to an operational amplifier circuit 152 configured in a conventional manner as a current to voltage converter. Operational amplifier 152 converts the analog current signal generated by D/A converter 148 to a corresponding analog voltage signal having an amplitude representative of the number of illuminated sensors 62. Like the previously described counter 136, it may be appropriate to adjustably control the level of the voltage signal generated on line 152 to allow for various types of fruit 14 having different sizes and optical transmission characteristics. Accordingly, the converter circuit 152 can include a manually adjustable gain for purposes of adjusting the output voltage signal level.

In accordance with the foregoing description, the analog voltage signal on line 154 can be characterized as a reference signal representative of the size of the fruit 14 being scanned. Referring specifically to FIG. 5*a*, the size reference signal on line 154 is applied to the "+" input terminal of previously described comparator circuit 112. As also previously described, the analog voltage signal representative of light intensity detected by the transmission sensors 40 during a sweep of the scanning beam 28 is applied to the "−" terminal of comparator circuit 112. The comparator circuit 112 is enabled at appropriate times during a transmission scan by means of an enabling input signal on line 98 generated by multiplex driver 92. By providing an enabling signal to the comparator 112, transients in the transmission scan signal on line 110 which may be generated when the multiplexer 108 switches from one analog switch to another can be ignored.

The comparator circuit 112 compares the transmission scan signal on line 110 with the size reference signal on line 154. If the scan signal on line 110 is smaller in amplitude than the size reference signal on line 154, the fruit 14 being scanned is determined to have a pit or pit fragment 12. Accordingly, an appropriate signal is generated on line 114 representative of the defective condition of fruit 14. It should be noted that the comparator circuit can be configured in a manner so as to effectively require that more than merely one of the sensors 40 detects a "blockage" for purposes of generating the appropriate signal on line 114. Correspondingly, the comparator circuit 112 can also be arranged so that the transmission scan signal on line 110 must indicate the presence of a pit or pit fragment 12 for two or more successive transmission scans. That is, various types of algorithms can be utilized in association with the comparative function provided by comparator circuit 112 to determine those signal characteristics which can be characterized as indicating the presence of a pit of pit fragment 12.

Figure 4:
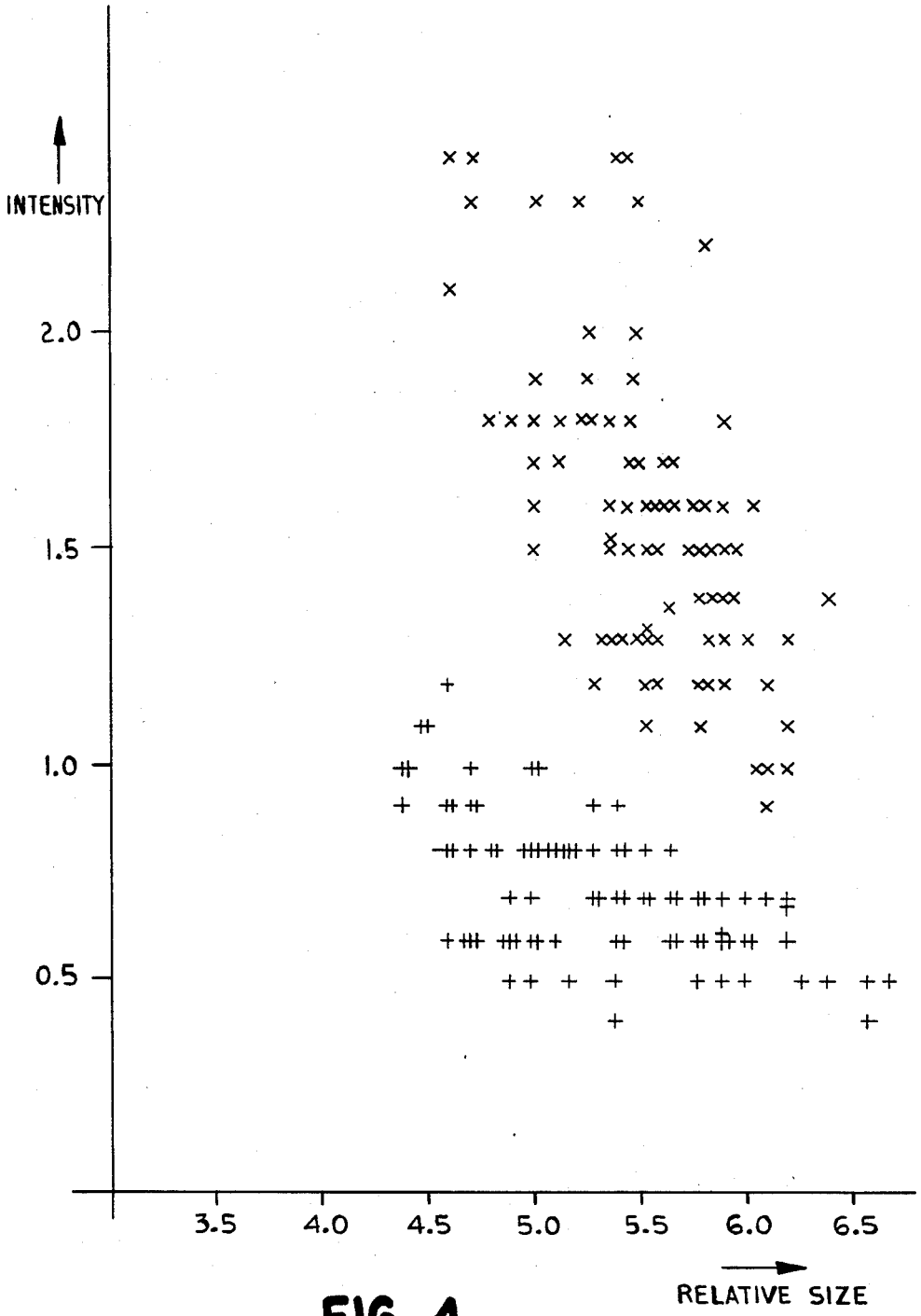
FIG. 4 is a light intensity graph showing the relationship between transmission light intensities received by the sensors, and the relative sizes of the fruit being inspected.

By comparing the transmission scan signal 110 to the size reference signal 154, the detection apparatus 10 will allow for differences in signal levels resulting from differences in fruit sizes. FIG. 4 depicts the relationship between fruit size and relative amplitudes of the transmission scan signal for various samples. It is apparent from FIG. 4 that increasing fruit size results in a decrease of transmission scan signal intensity level. Accordingly, if the size reference signal is relatively large, indicating a small fruit 14, levels of the transmission scan signal characterized as representative of the absence of a pit 12 are correspondingly increased.

When a pit or pit fragment 12 is determined to be present, the output signal of comparator circuit 112 on line 114 is applied as an input signal to reject timing circuitry 116 as depicted in FIG. 5*a*. Reject timing circuitry 116 can comprise any one of several conventional circuit designs to appropriately control the timing and duration of control signals for the ejector valve 76. Accordingly, the reject timing circuitry 116 is responsive to the output signal of comparator 112 on line 114 to generate an ejector control signal on line 74.

The ejector control signal on line 74 is applied as an input signal to the ejector valve 76 depicted in FIG. 5*a* and previously described with respect to FIG. 1. The function of ejector valve 76 is to remove a fruit 14 determined to have a pit or pit fragment 12 from its normal path of travel depicted in dotted line format in FIG. 1. For example, the ejector valve 76 can comprise an electropneumatic device having a conventional high speed solenoid valve operationally responsive to the reject timing control signal on line 74. That is, the reject control signal on line 74 causes the solenoid valve to be opened at the appropriate time when the fruit 14 determined to be defective is in front of a conventional pneumatic nozzle of valve 76. The high speed solenoid valve operates the nozzle to emit a short blast of compressed air to deflect the defective fruit 14 out of the normal path of travel of acceptable fruit.

Pit detection apparatus in accordance with the invention are not limited to the specific detection apparatus 10 described herein and depicted in FIGS. 1, 2, 5*a* and 5*b*. For example, in view of the common areas of the paths of transmission scanning beam 28 and sizing beam 52, and as previously described herein, background noise can result in extraneous light signals detected by the sensors 40 of transmission sensor array 38. The array 34 comprising imaging lenses 36 can be utilized to filter out of the scanning beam 28 the optical noise resulting from the sizing beam 52. However, alternatively, the optical backgound noise can be reduced by other means. For example either one or both of the sizing beam 52 and transmission scanning beam 28 can be modulated by means of optical filters so that sensor arrays 60 and 38 each will only detect light from the appropriate source or beam. Alternately either one, or both beams could be extinguished during the measurements involving the other beam.

In addition, the system depicted in FIGS. 5*a* and 5*b* is essentially an analog configuration. It will be apparent from the previous description that various portions of the pit detection circuitry 44 depicted in FIGS. 5*a* and 5*b* could be modified so as to provide essentially a digital detection system. For example, the transmission scan signal on line 110 as generated by multiplexer 108 could be converted from an analog to a digital signal wherein the analog signal is converted to a binary coded signal having binary information representative of the signal levels of the transmission scan signal on line 110.

The binary coded signal representative of the transmission scan signal on line 110 could then be directly applied to a microprocessor or other digital computer means in place of the previously described comparator circuit 112. Similarly, instead of utilizing the D/A converter circuit 148 and the current to voltage converter 152 within the size measuring circuitry, the binary coded count signal generated by latch circuit 144 could also be directly applied to the microprocessor or similar digital processing means.

In converting the detection circuitry 44 to a digitized arrangement, the microprocessor or digital computer means could utilize the output signal from synchronization circuit 46 as an appropriate timing signal. Similarly, appropriate timing of enablement of the microprocessor could be provided by an enable signal generated from the previously described multiplex driver 92.

The microprocessor or similar digital computer means could then be programmed to determine the presence or absence of a pit or pit fragment 12 in accordance with the binary coded transmission scan signal and the binary coded count signal. Furthermore, the digital computer means could also be programmed to require that a particular number of sensors 40 are required to generate an appropriate signal level representative of the presence of a pit or pit fragment 12 before a reject signal is applied to the ejector value 76. Similarly, biases in the signal levels which must be detected can also be programmed into the digital computer means as an operator input so as to allow for different types of fruit 14, with correspondingly different optical characteristics.

Figure 6:
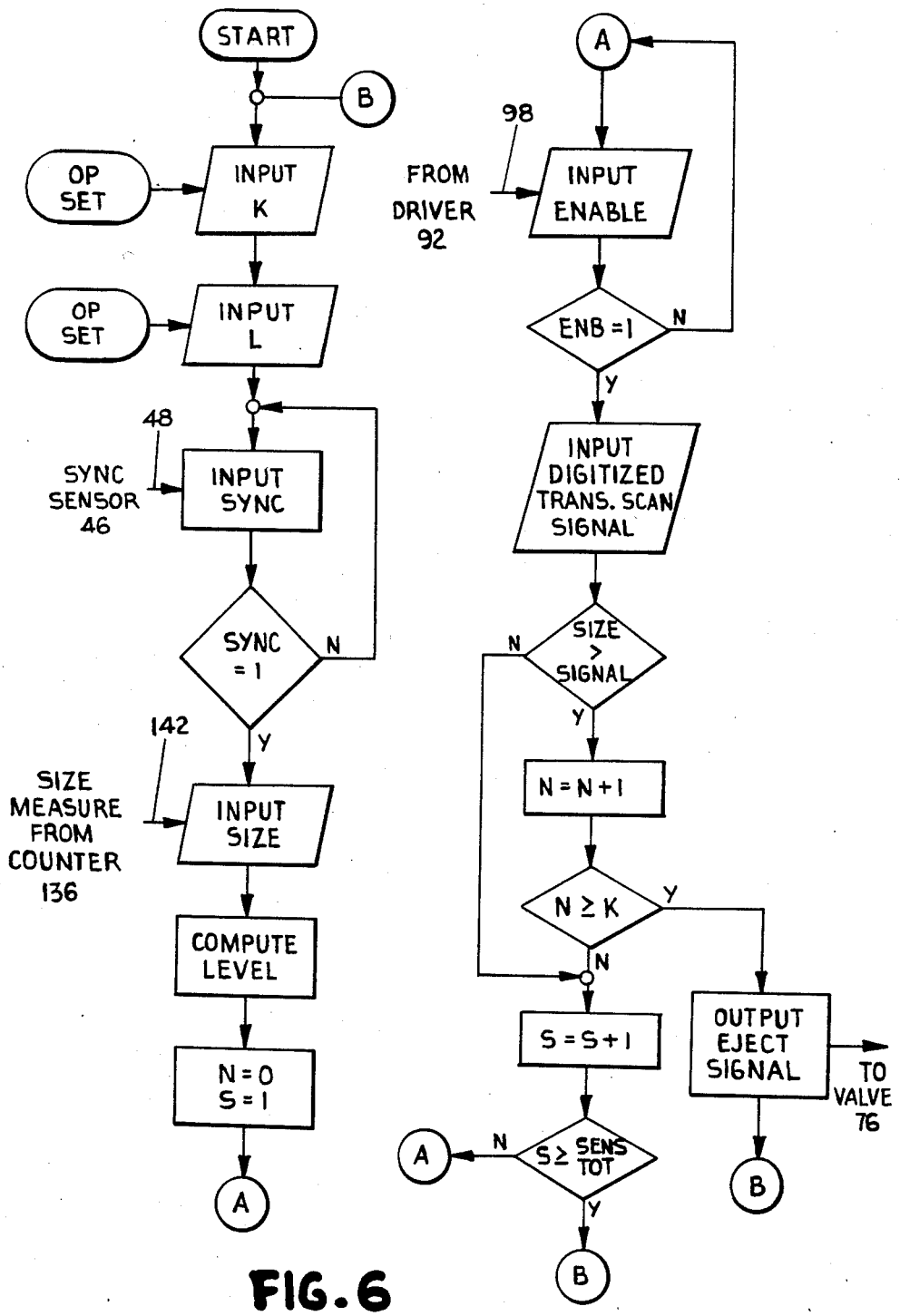
FIG. 6 is sequence diagram depicting the general sequence of instructions which can be employed in a digital embodiment of the pit detection circuitry.

An example program sequence which could be utilized in accordance with the foregoing description is shown in FIG. 6. Referring to FIG. 6, upon enablement of the digital computer means and receipt of signals representing that a scan computation should be initiated, inputs K and L can be stored for future computations, where K represents the number of sensors required to "see" the pit or pit fragment 12 before generation of a reject signal, and where L is a signal bias level appropriate for the particular type of fruit 14 being scanned. It should be emphasized that actual input of the values of K and L could occur by operative settings prior to initiation of the program sequence.

After initiation, the program sequence would enter a loop wherein the synchronization signal from synchronization circuit 46 is received and interrogated to determine if a transmission scan is being initiated. If the scan is not yet initiated, the program sequence will "loop" and continue to interrogate the synchronization signal until such time as a transmission scan is commenced.

After a scan is commenced, the digital computer means interrogates the binary coded count signal 142 indicative of the size of the fruit 14. An appropriate size level would then be calculated using not only the actual binary coded count signal, but also the bias L provided by the operator.

After calculation of an appropriate size level, a value N can be set to zero, wherein N is a variable representative of the number of sensors 40 generating appropriate signal levels representative of the presence of a pit or pit fragment 12. A second variable S can then be set to an initial value of 1, wherein S represents a particular sequence number of each of the sensors 62.

After the values of N and S have been initially set, the enable signal from multiplex driver circuit 92 is interrogated to determine if comparison should commence. The program sequence will loop until receipt of an appropriate enablement signal. After the enable signal is detected, the digitized transmission scan signal from the sensor corresponding to the sensor number S is input into the digital computer means. The sensor signal level is then compared to the size level as depicted in FIG. 6. If the size level signal is less than the transmission sensor signal level, the program sequence bypasses functional computations associated with rejection of the fruit 14. The sensor number S is then incremented by one and the number is compared to a fixed number representing the total number of sensors 40. If all of the sensors 40 have been interrogated, the program sequence will transfer control to initiation of the sequence. If all the sensors 40 have not been interrogated, representative of program sequence being within the scan interval, control is transferred back to instructions associated with interrogation of the enable signal from multiplex driver 92.

If the comparison of the size level and transmission scan signal level indicates that the transmission scan level is less than the size level, the variable N is incremented by one and compared to the number K representative of the total number of sensors required to detect the pit or pit fragment 12 prior to rejection of the fruit 14. If the variable N is less than K, rejection of the fruit 14 does not occur at that time and program sequence control is transferred to instructions associated with incrementing the sensor number. If, on the other hand, the variable N is now equal to the minimum number of sensors required to detect the pit or pit fragment 12, program sequence control is transferred to an input/output sequence for purposes of generating the appropriate reject signal and applying the signal to the reject timing circuitry 116. After determining that rejection of the fruit 14 should occur and the appropriate reject signal is generated, program sequence control is again transferred to sequence initiation.

It will be apparent to those skilled in the computer programming arts that the program sequence shown in FIG. 6 is merely representative of one of many program sequences which could be utilized to achieve the functions of pit detection apparatus 10 in accordance with the invention. For example, other program sequence configurations could be utilized requiring that transmission sensors 40 detect the presence of pit or pit fragments 12 in two or more successive scans before rejection of a fruit 14.

The principles of the invention are not limited to the specific pit detection appraratus described herein for detecting the presence or absence of pits or pit fragments in variously sized fruits. The pit detection apparatus can be utilized in various configurations adapted to detect the presence or absence of pits or pit fragments in fruit as they pass through an inspection zone. It will be apparent to those skilled in the art that modifications and variations of the above described illustrative embodiments of the invention may be effected without departing from the spirit and scope of the novel concepts of the invention.

The embodiments of the invention in which an exclusive property or privilege is claimed are defined as follows:

1. In a pit detection apparatus for detecting the presence of a pit in pieces of fruit as the fruit passes through a zone of inspection, and comprising first optical means for periodically transmitting a transmission scanning beam across the inspection zone, first sensing means for sensing the light intensity of the transmission scanning beam after the scanning beam has passed through the inspection zone and for generating transmission sensor signals indicative of the light intensity, and detection circuit means responsive to the transmission sensor signals for determining the presence of a pit based upon the amplitudes of the transmission sensor signals, the improvement which comprises:

path length means connected to the detection circuit means for determining the length of the optical path of the scanning beam through the fruit, and for generating a path length signal indicative thereof; and the detection circuit means is responsive to both the transmission sensor signals and to the path length signal for determining the presence of a pit based upon the amplitudes of the transmission sensor signals compensated by the amplitude of the path length signal.

2. The pit detection apparatus in accordance with claim 1 and further comprising:

synchronization detection means for detecting a position of the transmission scanning beam and for generating a scan sensor signal indicative thereof;

the first scanning means comprises a plurality of electro-optical sensors each electrically responsive to reception of light from the transmission scanning beam; and the detection circuit means is responsive to the scan sensor signal for determining the presence of a pit based only upon portions of the transmission sensor signals representative of light intensity detected by the transmission sensors during time intervals when the transmission scanning beam is within the field of view of each of the transmission sensors.

3. A pit detection apparatus in accordance with claim 1 wherein the detection circuit means further comprises filtering means for filtering from the transmission sensor signals those signal levels representative of ambient light intensity.

4. A pit detection apparatus in accordance with claim 1 and further comprising discrimination means for removing optical noise signals from the transmission scanning beam.

5. A pit detection apparatus in accordance with claim 1 wherein the path length means comprises:

second optical means for transmitting a path length detection beam across the inspection zone in a direction substantially transverse to the direction of the transmission scanning beam; and second sensing means for sensing the light intensity of the path length detection beam after the path length detection beam has passed through the inspection zone, and for generating the path length signal indicative thereof.

6. A pit detection apparatus in accordance with claim 1 wherein the detection circuit means comprises comparison means for comparing the path length signal indicative of the optical path length through the fruit with the transmission sensor signals, and for detecting the presence of a pit based on the comparison.

7. A pit detection apparatus in accordance with claim 6 wherein the comparison means compares the path length signal only with those portions of the transmission sensor signals representative of direct light sensed by the first sensing means from the transmission scanning beam.

8. A pit detection apparatus in accordance with claim 1 wherein:

the first sensing means comprises a plurality of electro-optical sensors arranged so that each sensor has an individual field of view of one portion of the inspection zone and generates a separate one of the transmission sensor signals; and the detection circuit means comprises amplifier means responsive to the transmission sensor signals for filtering out the signal levels representative of light intensity resulting from ambient light detected by the first sensing means.

9. A pit detection apparatus in accordance with claim 8 and further comprising:

synchronization detection means for detecting a position of the transmission scanning beam and for generating a scan sensor signal indicative thereof; and the amplifier means is responsive to the scan sensor signal for filtering the signal levels of the transmission sensor signals representative of ambient light.

10. A pit detection apparatus in accordance with claim 8 wherein the amplifier means comprises means for adjusting the gain of the transmission sensor signals to a selectively adjustable gain level.

11. A pit detection apparatus in accordance with claim 8 wherein the detection circuit means further comprises:

multiplexer means responsive to the transmission sensor signals for generating a transmission scan signal corresponding to the portion of each transmission sensor signal representative of light intensity sensed by a corresponding transmission sensor only during the time interval when the transmission scanning beam is directly within the field of view of the corresponding sensor.

12. A pit detection apparatus in accordance with claim 11 and further comprising:

synchronization detection means for detecting a position of the transmission scanning beam and for generating a scan sensor signal indicative thereof;

the detection circuit means further comprises multiplex driver means responsive to the scan sensor signal for sequentially transmitting a set of driver control signals; and the multiplexer means is responsive to the driver control signals for sequentially sampling each of the transmission sensor signals only during the time intervals that each of the transmission sensor signals is representative of light intensity sensed by a corresponding transmission sensor when the transmission scanning beam is directly within the field of view of the corresponding sensor.

13. A pit detection apparatus in accordance with claim 12 wherein the detection circuit means further comprises:

comparison means for comparing the transmission scan signal with the path length signal indicative of the optical path length through the fruit, and for generating a rejection signal indicative of the presence of a pit when the transmission scan signal is below a signal level determined by the path length signal.

14. A pit detection apparatus in accordance with claim 13 wherein the comparison means comprises means for generating the rejection signal only in response to at least two of the transmission sensor signals being indicative of the presence of a pit.

15. A pit detection apparatus in accordance with claim 13 wherein the comparison means comprises means for generating the rejection signal only in response to at least two of the transmission scan signals, each representative of a particular scan, being indicative of the presence of a pit.

16. A pit detection apparatus in accordance with claim 13 and further comprising ejection means responsive to the rejection signal for removing the fruit determined to have a pit from the normal path of travel of fruit determined to have an absence of pits.

17. A pit detection apparatus in accordance with claim 13 wherein the detection circuit means further comprises processor means responsive to a digitized representation of the transmission scan signal and the path length signal for generating a rejection signal indicative of the presence of a pit when the signal levels of the digitized transmission scan signal are below a level determined by the path length signal.

18. A pit detection apparatus in accordance with claim 1 wherein the first optical means comprises:

a light source generating means for generating a substantially narrow collimated beam of light; and a rotating mirror positioned relative to the position of the light source generating means so that the collimated beam of light impinges on the sides of the rotating mirror in a manner so as to transmit the transmission scanning beam across the inspection zone.

19. A method for detecting the presence of pits in pieces of fruit as the fruit passes through a zone of inspection, the method comprising the steps of:

periodically transmitting an optical transmission scanning beam across the inspection zone;

sensing the light intensity of the transmission scanning beam after the beam has passed through the inspection zone, and generating transmission sensor signals indicative thereof;

determining the length of the optical path of the scanning beam through the fruit, and generating a path length signal indicative thereof; and detecting the presence of a pit based upon the amplitudes of the transmission sensor signals compensated by the amplitude of the path length signal.

20. The method in accordance with claim 19 wherein the method further comprises the steps of:

detecting a position of the transmission scanning beam during each scan thereof, and generating a scan sensor signal indicative of the position; and determining the presence of a pit based only upon portions of the transmissions sensor signal representative of direct light intensity of the transmission scanning beam.

21. The method in accordance with claim 19 and further comprising the steps of:

transmitting an optical path length detection beam across the inspection zone in a direction transverse to the direction of the transmission scanning beam; and sensing the light intensity of the path length detection beam after the sizing beam has passed through the inspection zone, and generating the path length signal in accordance with the portion of the beam which is blocked by the fruit.

22. The method in accordance with claim 19 and further comprising the steps of:

detecting the number of transmission sensor signals or the number of periodic scans of a single piece of the fruit indicative of the presence of a pit; and generating a rejection signal indicative of the presence of a pit only when at least two transmission sensor signals or at least two scans are indicative of the presence of a pit.

* * * * *